US008888215B2

(12) United States Patent
Mitsui

(10) Patent No.: US 8,888,215 B2
(45) Date of Patent: Nov. 18, 2014

(54) INKJET RECORDING DEVICE, INKJET RECORDING METHOD, AND INKJET RECORDING SYSTEM

(71) Applicant: Seiko Epson Corporation, Shinjuku-ku (JP)

(72) Inventor: Yoichi Mitsui, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/015,304

(22) Filed: Aug. 30, 2013

(65) Prior Publication Data

US 2014/0063087 A1 Mar. 6, 2014

(30) Foreign Application Priority Data

Aug. 31, 2012 (JP) ..... 2012-191465

(51) Int. Cl.

| | |
|---|---|
| ***B41J 29/38*** | (2006.01) |
| ***B41J 2/01*** | (2006.01) |
| ***B41J 2/07*** | (2006.01) |
| ***B41J 3/407*** | (2006.01) |
| ***B41J 2/21*** | (2006.01) |

(52) U.S. Cl.

CPC *B41J 2/07* (2013.01); *B41J 3/4078* (2013.01); *B41J 2/2132* (2013.01)

USPC ..... 347/9; 347/5; 347/104

(58) Field of Classification Search

CPC ..... B41J 11/0095; B41J 13/103; B41J 3/00; B41J 13/0027; B41J 2/2132

USPC ..... 347/5, 9, 14, 104

See application file for complete search history.

(56) References Cited

FOREIGN PATENT DOCUMENTS

| | | | |
|---|---|---|---|
| EP | 0679518 | A1 | 11/1995 |
| EP | 0936075 | A2 | 8/1999 |
| EP | 1078770 | A1 | 2/2001 |
| JP | 2001-260332 | A | 9/2001 |
| JP | 2002-103584 | A | 4/2002 |

OTHER PUBLICATIONS

The extended European Search Report for European Application No. 13182428.6 mailed Dec. 6, 2013.

*Primary Examiner* — Jannelle M Lebron

(74) *Attorney, Agent, or Firm* — Global IP Counselors, LLP

(57) ABSTRACT

The advantage of the invention is to provide an inkjet recording method and the like in which an unprinted portion due to a multipath method is not left in a back end portion of a printed image and the value as a printed material is not undermined in a case where a printing operation by a multipath method is temporarily stopped in the middle and the printing operation is resumed after feeding a recording medium. A printing operation is temporarily stopped after conducting a back end portion line formation process for forming a raster line so as to prevent an unprinted portion due to an multipath method from being left in a back end portion of a printed image which has been printed halfway when temporarily stopping the printing operation in the middle.

6 Claims, 7 Drawing Sheets

INKJET RECORDING DEVICE, INKJET RECORDING METHOD, AND INKJET RECORDING SYSTEM

CROSS-REFERENCE TO RELATED APPLICATIONS

This application claims priority to Japanese Patent Application No. 2012-191465 filed on Aug. 31, 2012. The entire disclosure of Japanese Patent Application No. 2012-191465 is hereby incorporated herein by reference.

BACKGROUND

1. Technical Field

The present invention relates to an inkjet recording device, an inkjet recording method, and an inkjet recording system for printing a recording medium such as fabric or the like.

2. Background Technology

A textile printer has been known in which printing is conducted by forming a plurality of recording lines arranged in a delivery direction by a multipath recording method while moving a recording medium with respect to an inkjet head (for example, Patent Document 1). In this type of textile printer, an unprinted portion is generated due to the multipath recording method in a back end portion of a printed image at the end of printing. Therefore, a recording line is formed so as to prevent the unprinted portion from being left, and thereafter the printing is ended.

Japanese Laid-open Patent Publication No. 2001-260332 (Patent Document 1) is an example of the related art.

SUMMARY

Problem to be Solved by the Invention

In a case where printing is conducted to fabric by a textile printer, printing is conducted by an inkjet head while reeling out fabric wound in a roll shape. Generally, when the roll of fabric comes to the end of the fabric (terminal end portion), the printing is continued by sewing up the terminal end portion of the fabric and a leading end portion of fabric of a next roll with a sewing machine or the like. In such a case, since the seam portion of the fabric is thick, there is a possibility that the seam portion interferes with the inkjet head when the seam portion passes through the moving path of the inkjet head. In order to address this situation, it is possible to temporarily stop the printing operation in the middle, move the inkjet head to the side of the feed route of the fabric, and then feed the fabric until the seam portion passes through the moving path of the inkjet head. After that, the printing operation is resumed.

Then, in a case where the printing operation is temporarily stopped in the middle, an unprinted portion due to the multipath method is generated in the back end portion of the printed image which has been printed halfway in the same manner as in the back end portion of the printed image at the end of printing. However, a conventional textile printer does not form a recording line (raster line) so as to prevent the unprinted portion due to the multipath method from being left in the case where the printing operation is temporarily stopped in the middle differently from the case of the end of printing. Therefore, in a case where the printing operation is temporarily stopped in the middle and the printing operation is resumed after feeding the recording medium, or in a case where the printing operation is temporarily stopped in the middle and thereafter the printing is ended without resuming the printing operation, the unprinted portion due to the multipath method is left, which causes a decrease in the value as a printed material.

The advantage of the invention is to provide an inkjet recording device, an inkjet recording method, and an inkjet recording system in which an unprinted portion due to a multipath method is not left in a back end portion of a printed image and the value as a printed material is not undermined in a case where a printing operation by a multipath method is temporarily stopped in the middle and the printing operation is resumed after feeding a recording medium.

Means for Solving Problem

An inkjet recording device according to the invention includes an image formation section which forms a plurality of raster lines arranged in a scanning direction and prints a printed image by a multipath method while relatively moving a recording medium with respect to an inkjet head in the scanning direction, and a control section which temporarily stops a printing operation after causing the image formation section to conduct a back end portion line formation process for forming a raster line so as to prevent an unprinted portion due to the multipath method from being left in a back end portion of the printed image which has been printed halfway when temporarily stopping the printing operation by the image formation section in the middle.

An inkjet recording method according to the invention is an inkjet recording method which forms a plurality of raster lines arranged in a scanning direction and prints a printed image by a multipath method while relatively moving a recording medium with respect to an inkjet head in the scanning direction, in which a printing operation is temporarily stopped after conducting a back end portion line formation process for forming a raster line so as to prevent an unprinted portion due to the multipath method from being left in a back end portion of the printed image which has been printed halfway when temporarily stopping the printing operation in the middle.

An inkjet recording system according to the invention includes an inkjet recording device and a control device which controls the inkjet recording device, the inkjet recording device including an image formation section which forms a plurality of raster lines arranged in a scanning direction and prints a printed image by a multipath method while relatively moving a recording medium with respect to an inkjet head in the scanning direction, and the control device including a control section which temporarily stops a printing operation after causing the inkjet recording device to conduct a back end portion line formation process for forming a raster line so as to prevent an unprinted portion due to the multipath method from being left in a back end portion of the printed image which has been printed halfway when temporarily stopping the printing operation by the inkjet recording device in the middle.

With this configuration, a printing operation is temporarily stopped after conducting a back end portion line formation process for forming a raster line so as to prevent an unprinted portion due to a multipath method from being left in a back end portion of a printed image which has been printed halfway when temporarily stopping the printing operation in the middle. Therefore, the unprinted portion due to a multipath method is not left. Consequently, even in a case of temporarily stopping the printing operation by the multipath method in the middle, the value as a printed material is not undermined.

Preferably, the above-described inkjet recording device further includes an input section which allows a user to input a temporary stop command to temporarily stop a printing operation in the middle, and the control section temporarily stops the printing operation after causing the image formation section to conduct a back end portion line formation process based on input of the temporary stop command.

With this configuration, a user can temporarily stop a printing operation at an optional timing by the input section. Further, in a case where the temporary stop command is input, the control section temporarily stops the printing operation after causing the image formation section to conduct a back end portion line formation process. Therefore, the unprinted portion due to a multipath method is not left.

Here, preferably, the above-described inkjet recording device further includes a display section which displays an operation selection screen including execution of a back end portion line formation process as a choice. The control section tentatively stops the printing operation based on input of the temporary stop command and causes the display section to display the operation selection screen, and in a case where execution of a back end portion line formation process is selected on the operation selection screen, the control section temporarily stops the printing operation after causing the image formation section to conduct a back end portion line formation process.

With this configuration, the back end portion line formation process can be conducted as needed when temporarily stopping the printing operation. For example, in a case where there is no problem with an unprinted portion being left, a user does not select execution of a back end portion line formation process on the operation selection screen, so that the time or ink required for the back end portion line formation process can be saved.

Here, preferably, the control section causes the image formation section to conduct a leading end portion line formation process for forming a raster line so as to prevent an unprinted portion due to the multipath method from being left in a leading end portion of a printed image which is printed after resuming when resuming a printing operation by the image formation section.

With this configuration, the leading end portion line formation process for forming a raster line is conducted so as to prevent an unprinted portion due to the multipath method from being left in a leading end portion of a printed image which is printed after resuming. Therefore, the unprinted portion due to a multipath method is not left in a leading end portion of a printed image which is printed after resuming.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
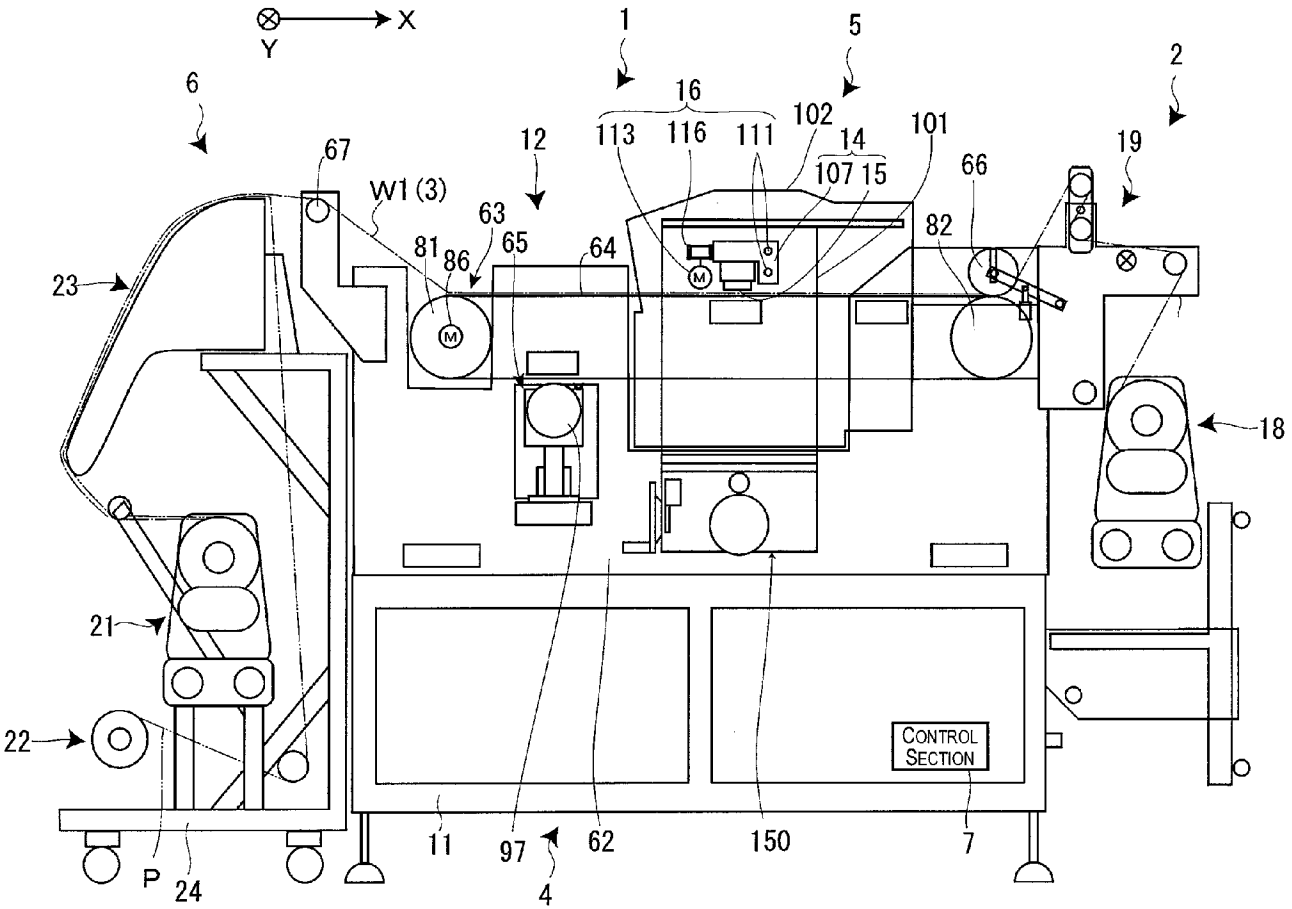
FIG. 1 is a configuration diagram of an inkjet recording system according to an embodiment.

Hereinafter, an inkjet recording device according to an embodiment of the invention will be explained with reference to the attached drawings. As shown in FIG. 1, the inkjet recording device 1 conducts printing (textile printing) of patterns or the like by an inkjet method using dye ink to a recording medium W such as fabric or the like to be fed and removed by a so-called reel-to-reel method. In the following explanation of the inkjet recording device 1, a forward and backward feed direction of the recording medium W is defined as an X axial direction, and a direction orthogonal to the X axial direction is defined as a Y axial direction.

As shown in the same drawing, the inkjet recording device 1 has a reeling-out section 2, a device main body 4, a printing section 5, and a winding section 6. The reeling-out section 2 reels out and feeds the recording medium W wound in a roll shape. The device main body 4 feeds the recording medium W, which has been reeled out, along a feed route 3 for printing. The printing section 5 is arranged above the device main body 4, and conducts printing to the recording medium W by an inkjet method in cooperation with the device main body 4. The winding section 6 withdraws the recording medium W, to which printing has been conducted by the printing section 5, by winding it on the downstream side of the feed direction of the device main body 4. The inkjet recording device 1 further has a control section 7 which conducts overall control of the entire device, and a display section 8 and an operation section 9 which provide interface to a user (see FIG. 2).

The device main body 4 has a main body base 11 constructed by assembling steel materials, and a medium feed mechanism 12 which is supported by the main body base 11 and intermittently feeds the recording medium W in the X axial direction by belt delivery. The printing section 5 has a carriage unit 14 which has an inkjet head 15, and a head moving mechanism 16 which moves the carriage unit 14 back and forth in the Y axial direction. On the other hand, the reeling-out section 2 has a reeling-out unit 18 which reels out the recording medium W, and a slack take-up unit 19 for taking up the slack of the recording medium W which has been reeled out. The winding section 6 has a winding unit 21 which winds the recording medium W, a slip sheet unit 22 which supplies a slip sheet to the winding unit 21, and a heater unit 23 for vaporizing a solvent (moisture) of dye ink which has soaked into the recording medium W before winding the recording medium W. The winding section 6 is constructed by installing the winding unit 21, the slip sheet unit 22, and the heater unit 23 in a winding section base 24.

The slack of the recording medium W reeled out from the reeling-out unit 18 is taken up such that tension is given by the slack take-up unit 19, and then the recording medium W is fed to the medium feed mechanism 12. The recording medium W fed to the medium feed mechanism 12 is delivered by a belt such that the recording medium W adheres to the surface of the belt. While intermittently feeding (sub scanning) the recording medium W in the X axial direction by this belt delivery, the carriage unit 14 moves back and forth (main scanning) in the Y axial direction in synchronization with this, and ink is ejected from the inkjet head 15. Consequently, a plurality of raster lines arranged in the X axial direction (sub scanning direction) are formed, and printing of an printed image is conducted. More specifically, this printing operation is conducted by an interlaced method described below.

After printing is conducted in this manner, a portion of the recording medium W in which printing has been completed (a portion in which textile printing has been completed) is fed from the medium feed mechanism 12 to the winding section 6. In the winding section 6, a slip sheet P is continuously supplied from the slip sheet unit 22 to the recording medium W fed from the medium feed mechanism 12, and the slip sheet P and the recording medium W overlapped with each other are fed to the heater unit 23. In the heater unit 23, the recording medium W is heated together with the slip sheet P, and a solvent (moisture) of dye ink is vaporized. Then, the recording medium W in which textile printing has been completed and a drying process has been conducted is wound by the winding unit 21 together with the slip sheet P.

The medium feed mechanism 12 has a pair of side frames 62 which is mounted and fixed onto the above-described main body base 11 on the right and left (in the Y axial the direction), a belt delivery unit 63 which is supported by the pair of side frames 62 and has a delivery belt 64 with no end, and a belt cleaner unit 65 which is arranged below the belt delivery unit 63 and cleans the delivery belt 64 with a rotation brush 97. The medium feed mechanism 12 also has a pressing roller 66 and a separating roller 67. The pressing roller 66 faces the belt delivery unit 63 from above on the upstream side, and attaches the recording medium W, which has been fed from the slack take-up unit 19, to the delivery belt 64. The separating roller 67 is arranged obliquely above the belt delivery unit 63 on the downstream side, and peels the recording medium W after printing from the delivery belt 64 so as to feed it to the winding section 6.

The belt delivery unit 63 has a driving pulley 81 which is located on the downstream side of the feed direction, a driven pulley 82 which is located on the upstream side of the feed direction, and the delivery belt 64 with no end which is bridged between the driving pulley 81 and the driven pulley 82. The driving pulley 81 and the driven pulley 82 are supported by the pair of side frames 62 in a rotatable manner through special bearings. A delivery motor 86 for intermittently running the delivery belt 64 is coupled with an axial end of the driving pulley 81. The delivery belt 64 is constructed of a special wide belt having adhesion property (adhesion process) on the outer circumferential surface (front surface), and feeds the recording medium W in the X axial direction by attaching the recording medium W thereto. Consequently, the recording medium W is fed for printing (intermittently fed) right below the printing section 5 without the occurrence of curl.

The printing section 5 has a printer frame 101, the head moving mechanism 16, the carriage unit 14, and a printer cover 102. The printer frame 101 extends in the Y axial direction so as to straddle the feed route 3 (the belt delivery unit 63). The head moving mechanism 16 is supported by the printer frame 101. The carriage unit 14 is installed in the head moving mechanism 16, and moves back and forth in the Y axial direction. The printer cover 102 covers these. Although they are not shown in the drawings, a cap unit, a cleaning unit, and the like for maintenance of the inkjet head 15 are installed in the printing section 5. Further, a gap adjusting section 150 is provided to adjust a work gap G between a nozzle surface of the inkjet head 15 and the recording medium W on the delivery belt 64 by moving the entire printing section 5 up and down with respect to the device main body 4 (the medium feed mechanism 12).

The carriage unit 14 has the inkjet head 15 and a carriage 107. The inkjet head 15 has lines of nozzles for a plurality of colors for color printing. The carriage 107 retains the inkjet head 15 so as to arrange the lines of nozzles in parallel with the X axial direction. Dye ink of each color to be supplied to each line of nozzles is supplied from a so-called off-carriage ink tank.

The head moving mechanism 16 has two carriage guides 111, a timing belt 116, and a carriage motor 113. The carriage guides 111 slidably support the carriage unit 14 in the Y axial direction with a cantilever structure. The timing belt 116 moves the carriage unit 14 back and forth along the carriage guides 111. The carriage motor 113 runs the timing belt 116 forward and backward. When the timing belt 116 is caused to run forward and backward by the carriage motor 113, the carriage unit 14 is guided by the carriage guides 111 and moves back and forth in the Y axial direction.

Figure 2:
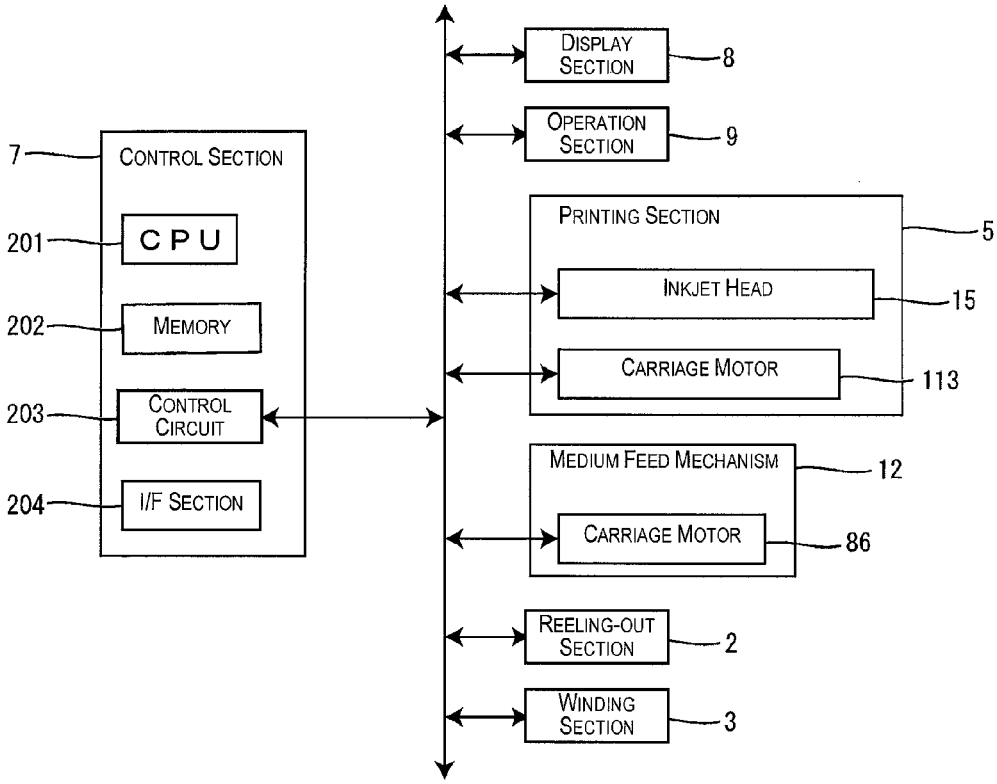
FIG. 2 is a control block diagram of the inkjet recording system.

As shown in FIG. 2, the control section 7 has a CPU 201 (Central Processing Unit), a memory 202, a control circuit 203, and an interface section 204 (I/F section). The CPU 201 is an arithmetic processing unit for conducting control of the entire inkjet recording device 1. The memory 202 secures an area which stores a program to be executed in the CPU 201, a work area, and the like. The control circuit 203 controls each section of the inkjet recording device 1 based on a control signal output from the CPU 201. The interface section 204 transmits and receives data between a computer (not shown in the drawing) as an external device and the inkjet recording device 1.

The display section 8 is constructed of a liquid crystal display, for example. The operation section 9 is constructed of various kinds of hard keys, a touch panel provided on a front surface of the display section 8 (liquid crystal display), and the like. The display section 8 displays choices of various kinds of commands by GUI (Graphical User Interface) buttons or the like, and various kinds of commands are input when a user selects a command by the operation section 9. The display section 8 and the operation section 9 are attached to an external surface (the printer cover 102) of the printing section 5.

The inkjet recording device 1 of the present embodiment conducts a printing operation by an interlaced method which is one of multipath methods. The interlaced method is a printing operation which forms a raster line in a main scan between raster lines formed in another main scan. Hereinafter, one example thereof will be explained with reference to FIG. 3 in detail. For convenience of explanation, FIG. 3 is illustrated such that the number of nozzles 15*n* of the inkjet head 15 is small (seven), and the inkjet head 15 moves in the X axial direction (sub scanning) with respect to the recording medium W to show the relative position between the inkjet head 15 and the recording medium W.

Figure 3:
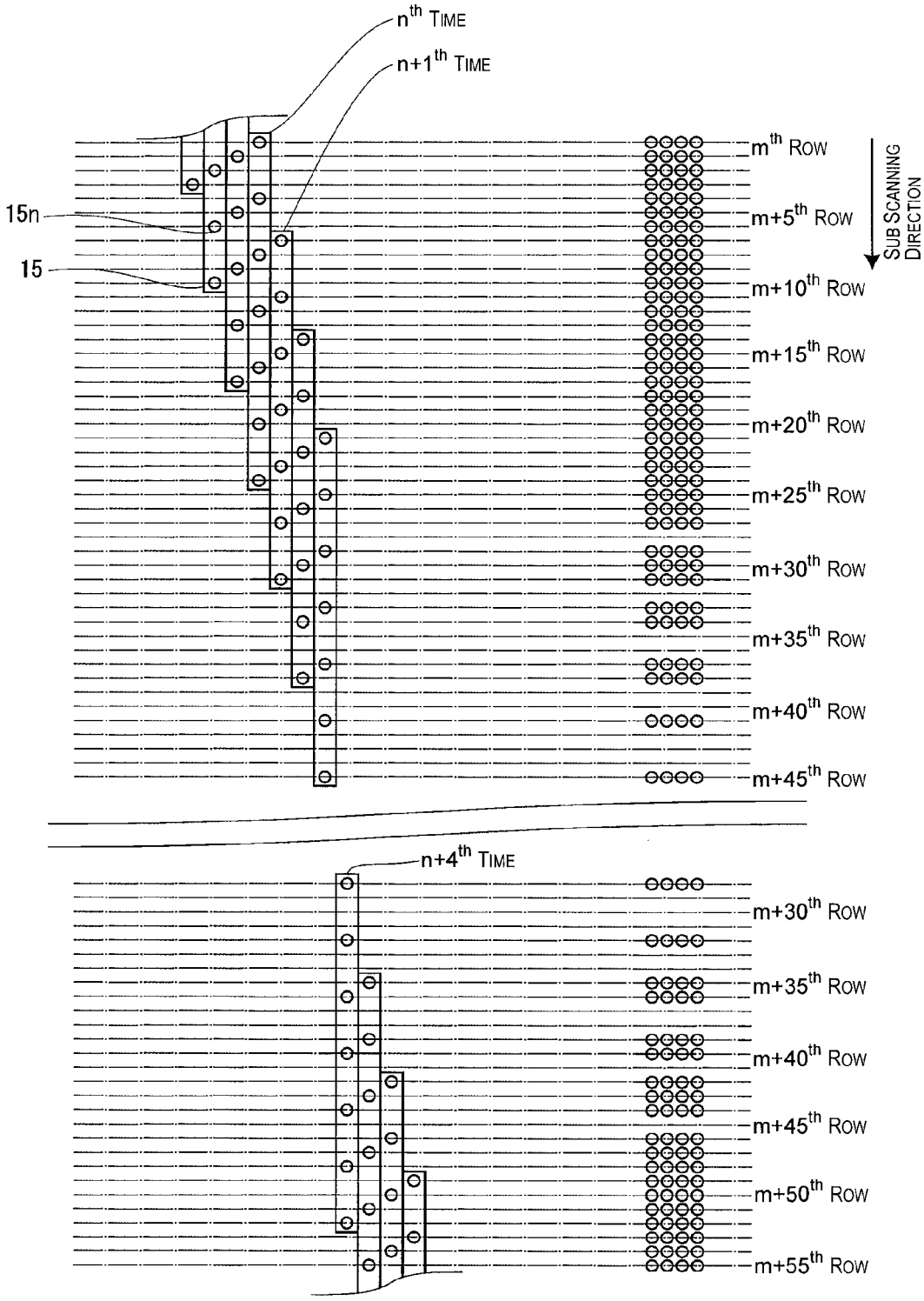
FIG. 3 is a diagram that schematically shows a printing operation by an interlaced method in the inkjet recording system.

As shown in FIG. 3, in the printing operation by the interlaced method, seven raster lines including an $m^{th}$ row, an $m+4^{th}$ row, an $m+8^{th}$ row, an $m+12^{th}$ row, an $m+16^{th}$ row, an $m+20^{th}$ row, and an $m+24^{th}$ row are formed by the seven nozzles 15*n* in an $n^{th}$ main scan. The nozzle pitch of the inkjet head 15 corresponds to four times of the line pitch of the raster lines.

Subsequently, after relative movement (sub scan) of the inkjet head 15 by seven times of the line pitch, seven raster lines including an $m+7^{th}$ row, an $m+11^{th}$ row, an $m+15^{th}$ row, an $m+19^{th}$ row, an $m+23^{th}$ row, an $m+27^{th}$ row, and an $m+31^{th}$ row are formed in an $n+1^{th}$ main scan.

In this manner, by repeating a main scan which forms seven raster lines and a sub scan of seven times of the line pitch, a plurality of raster lines are formed in the sub scanning direction. More specifically, seven raster lines from the $m^{th}$ row to the $m+6^{th}$ row are formed by the first nozzle 15*n*, the third nozzle 15*n*, the fifth nozzle 15*n*, the seventh nozzle 15*n*, the second nozzle 15*n*, the fourth nozzle 15*n*, and the sixth nozzle 15*n*, respectively. Next seven raster lines from the m+7$^{th}$ row to the m+13$^{th}$ row are formed by the nozzles of the same order, respectively, and subsequently this is repeated. Therefore, the raster lines of rows adjacent to each other are formed in main scans of a different number of times.

On the other hand, in a case where the printing operation is temporarily stopped in the middle of printing an image, a stripe-shaped unprinted portion (a portion in which raster lines are not formed) is generated in a back end portion of the printed image in which printing has been conducted halfway. More specifically, as shown in FIG. 3, in a case where the printing operation is temporarily stopped after the n+3$^{th}$ main scan, raster lines up to the m+45$^{th}$ row have been formed. Among them, however, nine rows including the m+28$^{th}$ row, the m+32$^{th}$ row, the m+35$^{th}$ row, the m+36$^{th}$ row, the m+39$^{th}$ row, the m+40$^{th}$ row, the m+42$^{th}$ row, the m+43$^{th}$ row, and the m+44$^{th}$ row have not been formed before the printing operation is temporarily stopped, which results in the stripe-shaped unprinted portion. That is, the back end portion of the printed image in which printing has been conducted halfway refers to an unprinted portion of the printed image in which printing has been conducted halfway.

Further, in a case where the recording medium W is fed while the printing operation is being temporarily stopped, a stripe-shaped unprinted portion is generated in a leading end portion of the printed image which is printed after resuming. More specifically, as shown in FIG. 3, after resuming, seven raster lines including the m+28$^{th}$ row, the m+32$^{th}$ row, the m+36$^{th}$ row, the m+40$^{th}$ row, the m+44$^{th}$ row, the m+48$^{th}$ row, and the m+52$^{th}$ row are formed by the seven nozzles 15*n* in the n+4$^{th}$ main scan. Subsequently, in the same manner as described above, by repeating a main scan which forms seven raster lines and a sub scan of seven times of the line pitch, a plurality of raster lines are formed in the sub scanning direction again. However, in the leading end portion of the printed image after resuming, a stripe-shaped unprinted portion is generated in nine rows including the m+29$^{th}$ row, the m+30$^{th}$ row, the m+31$^{th}$ row, the m+33$^{th}$ row, the m+34$^{th}$ row, m+37$^{th}$ row, the m+38$^{th}$ row, the m+41$^{th}$ row, and the m+45$^{th}$ row (nine rows formed before the printing operation is temporarily stopped).

Thus, when temporarily stopping the printing operation, the inkjet recording device 1 of the present embodiment temporarily stops the printing operation after conducting a back end portion line formation process (hereinafter also referred to as "forced division printing (first half)") for forming a raster line so as to prevent a stripe-shaped unprinted portion from being left in the back end portion of the printed image which has been printed halfway (up to the m+45$^{th}$ row). Also, when resuming the printing operation, a leading end portion line formation process (hereinafter also referred to as "forced division printing (second half)") for forming a raster line is conducted so as to prevent a stripe-shaped unprinted portion from being generated in the leading end portion of the printed image which is printed after resuming.

Figure 4:
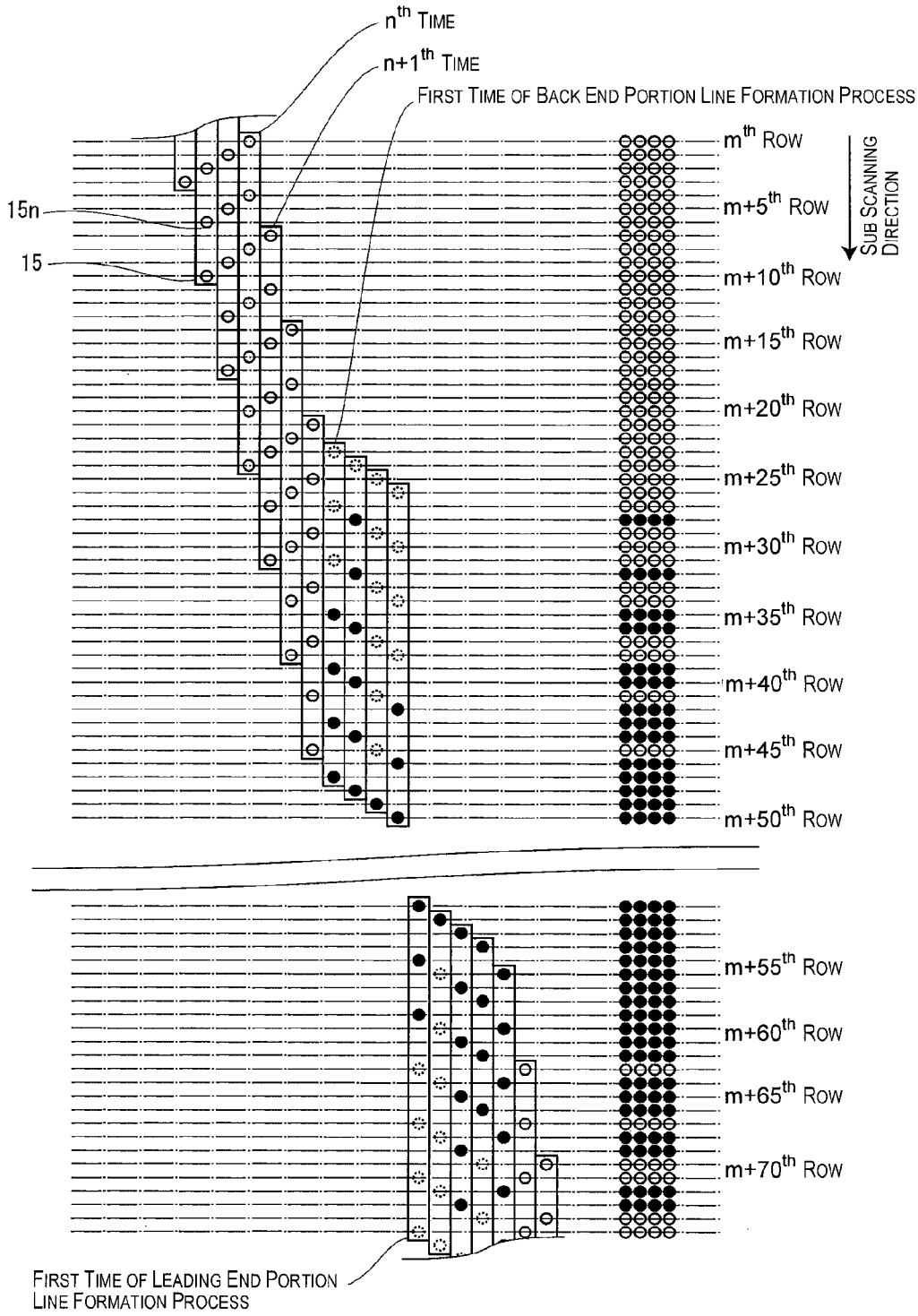
FIG. 4 is a diagram that schematically shows a back end portion line formation process and a leading end portion line formation process in the inkjet recording system.

The back end portion line formation process and the leading end portion line formation process will be explained in this order in detail with reference to FIG. 4. In FIG. 4, the nozzle 15*n* which forms a raster line is shown as a black circle, and the nozzle 15*n* which does not form a raster line is shown as a white circle with a broken line, in each main scan of the back end portion line formation process and the leading end portion line formation process. Also, a raster line (dot) formed by the back end portion line formation process and the leading end portion line formation process is shown as a black circle.

As shown in FIG. 4, a main scan is conducted four times as the back end portion line formation process, and raster lines are formed so as to prevent the unprinted portion from being left. Specifically, after relatively moving the inkjet head 15 by two times of the line pitch from a position before temporarily stopping the printing operation, raster lines are formed in the m+35$^{th}$ row, which are row, the m+39$^{th}$ row and the m+43$^{th}$ the unprinted portion, by the fourth nozzle, the fifth nozzle and the sixth nozzle 15*n* in the first main scan of the back end portion line formation process. Also, a raster line is formed in the m+47$^{th}$ row by the seventh nozzle 15*n*.

Subsequently, after relatively moving the inkjet head 15 by the line pitch, raster lines are formed in the m+28$^{th}$ row, the m+32$^{th}$ row, the m+36$^{th}$ row, the m+40$^{th}$ row and the m+44$^{th}$ row, which are the unprinted portion, by the second to the sixth nozzles 15*n* in the second main scan. Also, a raster line is formed in the m+48$^{th}$ row by the seventh nozzle 15*n*. Subsequently, after relatively moving the inkjet head 15 by the line pitch, a raster line is formed in the m+49$^{th}$ row by the seventh nozzle 15*n* in the third main scan. Finally, after relatively moving the inkjet head 15 by the line pitch, a raster line is formed in the m+42$^{th}$ row, which is the unprinted portion, by the fifth nozzle 15*n* in the fourth main scan. Also, raster lines are formed in the m+46$^{th}$ row and the m+50$^{th}$ row by the sixth and the seventh nozzles 15*n*.

As described above, in the back end portion line formation process, raster lines are filled up (formed) in nine rows which are the unprinted portion among the rows up to the m+45$^{th}$ row, and raster lines are also formed from the m+46$^{th}$ row to the m+50$^{th}$ row continuously (without generating an unprinted portion). Here, in the back end portion line formation process, raster lines can not be formed from the m+46$^{th}$ row to the m+50$^{th}$ row. In such a case, therefore, the third main scan in the back end portion line formation process becomes unnecessary.

Next, the leading end portion line formation process will be explained. In a case where raster lines are formed up to the m+50$^{th}$ row in the above-described line formation process, raster lines are formed in the m+51$^{th}$ row, the m+55$^{th}$ row and the m+59$^{th}$ row by the first, the second and the third nozzles 15*n* in the first main scan of the leading end portion line formation process. Subsequently, after relatively moving the inkjet head 15 by the line pitch, a raster line is formed in the m+52$^{th}$ row by the first nozzle 15*n* in the second main scan. Subsequently, after relatively moving the inkjet head 15 by the line pitch, raster lines are formed in the m+53$^{th}$ row, the m+57$^{th}$ row, the m+61$^{th}$ row, the m+65$^{th}$ row, the m+69$^{th}$ row and the m+73$^{th}$ row by the first to the sixth nozzles 15*n* in the third main scan. Subsequently, after relatively moving the inkjet head 15 by the line pitch, raster lines are formed in the m+54$^{th}$ row, the m+58$^{th}$ row, the m+62$^{th}$ row and the m+66$^{th}$ row by the first to the fourth nozzles 15*n* in the fourth main scan. Finally, after relatively moving the inkjet head 15 by two times of the line pitch, raster lines are formed in the m+56$^{th}$ row, the m+60$^{th}$ row, the m+64$^{th}$ row, the m+68$^{th}$ row, the m+72$^{th}$ row, the m+76$^{th}$ row and the m+80$^{th}$ row by the first to the seventh nozzles 15*n* in the fifth main scan.

As described above, raster lines are formed from the m+51$^{th}$ row to the m+62$^{th}$ row continuously without generating a stripe-shaped unprinted portion in the leading end portion of the printed image after resuming by five main scans after resuming. Also, in the m+63$^{th}$ row and the subsequent rows, a plurality of raster lines are formed in the sub scanning direction by repeating a main scan which forms raster lines of seven rows and a sub scan of seven times of the line pitch as described above subsequent to the five main scans after resuming.

Figure 5:
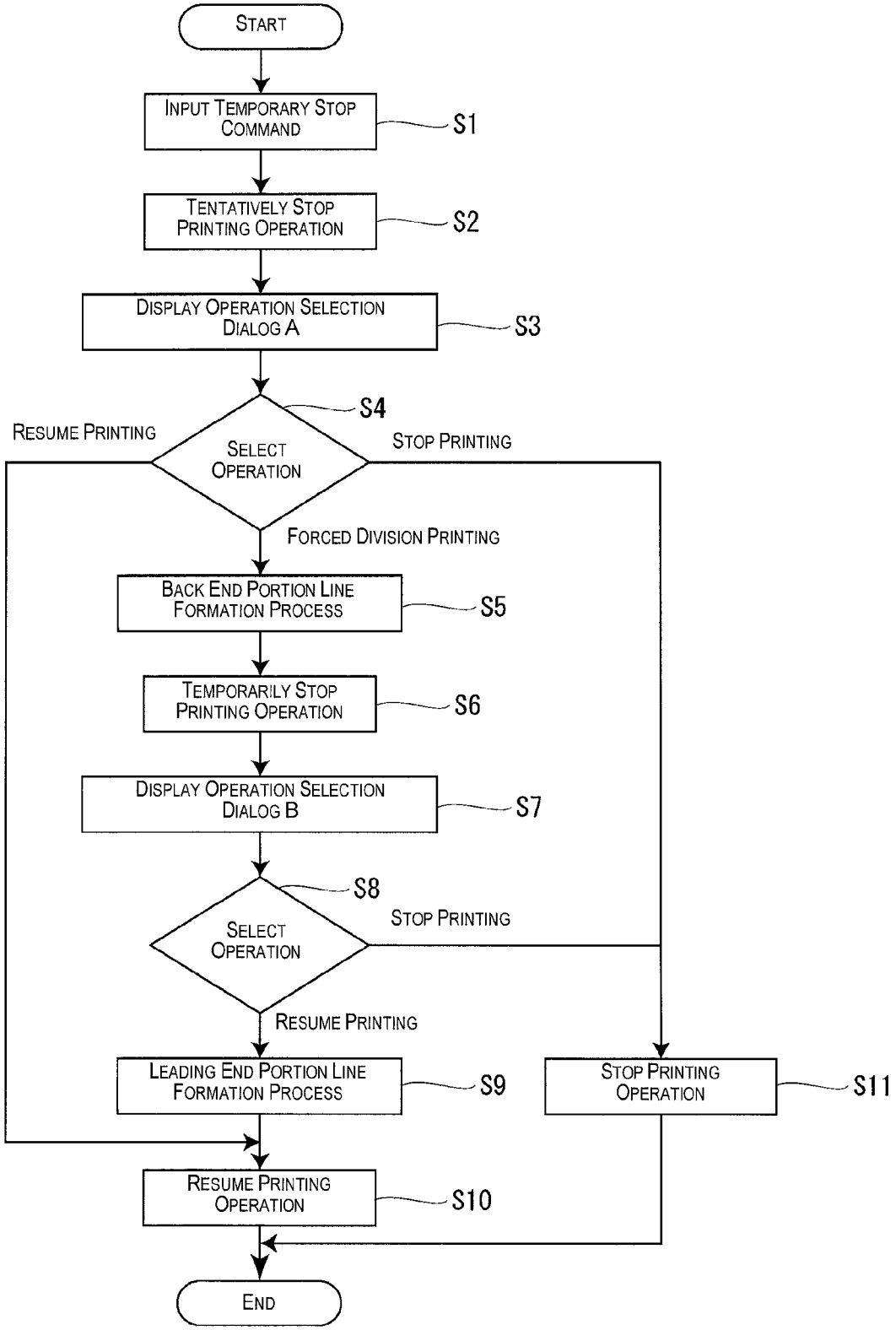
FIG. 5 is a flowchart that shows processes before and after temporarily stopping a printing operation in the inkjet recording system.

Processes before and after temporarily stopping a printing operation in the inkjet recording device 1 will be explained with reference to FIG. 5 and FIG. 6. Here, the following case will be explained. Specifically, when the recording medium W, which is a roll of fabric, comes to the end of the fabric, a user sews up a terminal end portion of the fabric and a leading end portion of a next fabric roll to continue the printing. In such a case, since the seam portion of the fabric is thick, the printing operation is temporarily stopped in the middle of printing an image, the inkjet head 15 is moved to the side of the feed route 3, and then the fabric is fed until the seam portion passes through the moving path (below the carriage guide 111) of the inkjet head 15. After that, the printing operation is resumed.

First, when the seam portion of the fabric approaches the moving path of the inkjet head 15, a user inputs a temporary stop command to temporarily stop the printing operation by the operation section 9 (S1). With this, the control section 7 controls the printing section 5 and the medium feed mechanism 12 so as to tentatively stop the printing operation (S2). In this instance, the inkjet head 15 (the carriage unit 14) is moved to the side of the feed route 3. At the same time, the control section 7 causes the display section 8 to display an operation selection dialog A as shown in FIG. 6 (S3). In the operation selection dialog A, a user can select one of three operations including "resume printing", "forced division printing", and "stop printing".

When a user selects "forced division printing" in the operation selection dialog A (S4: forced division printing), the control section 7 controls the printing section 5 and the medium feed mechanism 12 so as to conduct a back end portion line formation process (forced division printing (first half)) to the back end portion of the printed image which has been printed halfway (S5), and thereafter the printing operation is temporarily stopped (S6). In this instance, the inkjet head 15 is moved to the side of the feed route 3. In this state, a user conducts inputting by the operation section 9 to feed the fabric such that the seam portion of the fabric passes through the moving path of the inkjet head 15.

Figure 6:
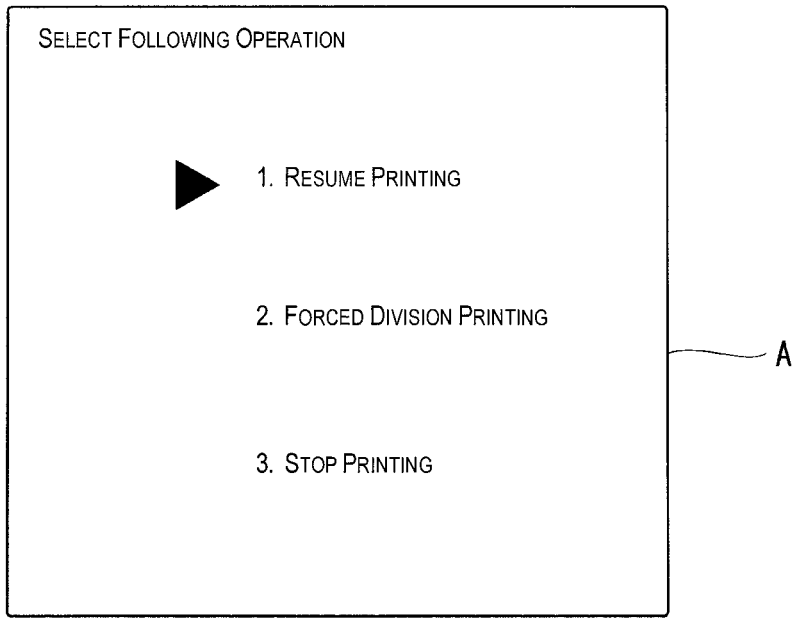
FIG. 6 is a diagram that shows an operation selection dialog A and an operation selection dialog B.
Figure 6:
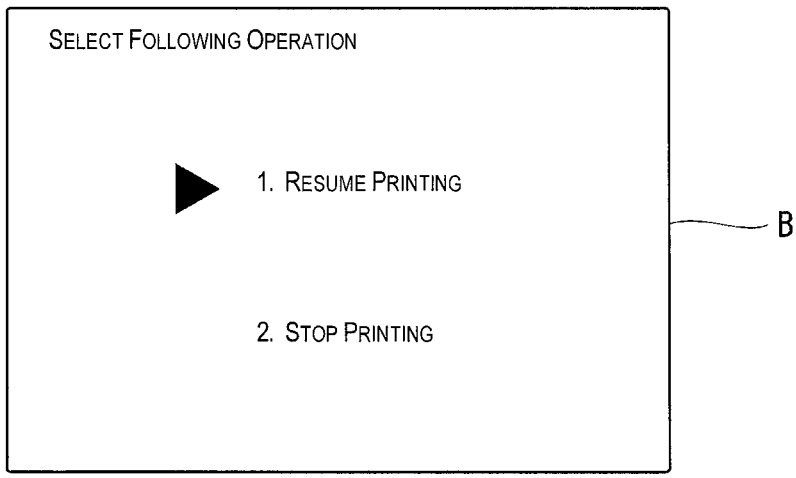

After temporarily stopping the printing operation, the control section 7 causes the display section 8 to display an operation selection dialog B as shown in FIG. 6 (S7). In the operation selection dialog B, a user can select one of two operations including "resume printing" and "stop printing". When a user selects "resume printing" in the operation selection dialog B after confirming that the seam portion of the fabric has passed through the moving path of the inkjet head 15 (S8: resume printing), the control section 7 controls the printing section 5 and the medium feed mechanism 12 so as to conduct a leading end portion line formation process (forced division printing (second half)) to the leading end portion of the printed image which is printed after resuming (S9), and thereafter the printing operation is resumed (S10). By the above-described series of processes, a printed image printed before temporarily stopping (an image before stopping) in which a stripe-shaped unprinted portion is not left in the back end portion and a printed image printed after resuming (an image after resuming) in which a stripe-shaped unprinted portion is not left in the leading end portion can be obtained.

In a case where there is no need to resume the printing operation, a user selects "stop printing" in the operation selection dialog B (S8: stop printing). With this, the control section 7 stops the printing operation directly from the state of temporarily stopping the printing operation (S11). In this case, an image before stopping in which a stripe-shaped unprinted portion is not left in the back end portion can be obtained. Incidentally, in this case, a user does not need to feed the fabric after temporarily stopping the printing operation (S6).

On the other hand, in a case where there is no problem with a stripe-shaped unprinted portion due to an interlaced method being left in the back end portion of the printed image which has been printed halfway or in the leading end portion of the printed image after resuming, a user operates the operation section 9 to feed the fabric such that the seam portion of the fabric passes through the moving path of the inkjet head 15 and then selects "resume printing" in the operation selection dialog A (S4: resume printing) after tentatively stopping the printing operation (S2). With this, the control section 7 controls the printing section 5 and the medium feed mechanism 12 so as to resume the printing operation (S10) without conducting a leading end portion line formation process. In this case, an image before stopping in which a stripe-shaped unprinted portion is left in the back end portion and an image after resuming in which a stripe-shaped unprinted portion is left in the leading end portion are obtained.

Also, in such a case, if there is no need to resume the printing operation, a user selects "stop printing" in the operation selection dialog A (S4: stop printing). With this, the printing operation is stopped directly from the state of temporarily stopping the printing operation (S11). In this case, an image before stopping in which a stripe-shaped unprinted portion is left in the back end portion is obtained.

As described above, according to the inkjet recording device 1 of the present embodiment, the printing operation is temporarily stopped (S6) after conducting the back end portion line formation process for forming a raster line (S5) so as to prevent a stripe-shaped unprinted portion due to an interlaced method from being left in the back end portion of the printed image which has been printed halfway when temporarily stopping the printing operation in the middle of printing the image. Therefore, a stripe-shaped unprinted portion due to an interlaced method is not left. Further, a leading end portion line formation process for forming a raster line (S9) is conducted so as to prevent a stripe-shaped unprinted portion due to an interlaced method from being left in a leading end portion of a printed image which is printed after resuming. Therefore, an unprinted portion due to an interlaced method is not left in the leading end portion of the printed image which is printed after resuming. Consequently, even in a case of temporarily stopping the printing operation by the interlaced method in the middle of printing the image, the value as a printed material (textile-printed material) is not undermined.

Further, when a user inputs a temporary stop command (S1), the operation selection dialog A is displayed on the display section 8 (S3), and in a case where there is no problem with a stripe-shaped unprinted portion being left, a user selects "resume printing" or "stop printing" (S4) in the operation selection dialog A so as not to conduct the back end portion line formation process. Consequently, the time or ink required for the back end portion line formation process can be saved. Also, it can be configured such that a user can select execution or non-execution of the back end portion line formation process on a setting screen or the like other than the operation selection dialog A when temporarily stopping the printing operation, and the back end portion line formation process can be executed every time the printing operation is temporarily stopped in a case where execution of the back end portion line formation process is set.

According to the present embodiment, when a user inputs a temporary stop command, the above-described series of processes are conducted. However, the back end portion line formation process and the leading end portion line formation process can be conducted when the seam portion of the fabric or some abnormality is detected by a sensor or the like provided in each section of the inkjet recording device 1 and the control section 7 temporarily stops the printing operation automatically based on the detection.

Instead of displaying the operation selection dialog A and the operation selection dialog B, an operation button can be provided corresponding to each command and a lamp can be provided to display an acceptance status of each operation button (for example, the lamp is turned on in a acceptance state and the lamp is turned off in a non-acceptance state). More specifically, three operation buttons and three lamps are provided corresponding to "resume printing", "forced division printing", and "stop printing". Then, instead of displaying the operation selection dialog A, the lamp which corresponds to "resume printing", the lamp which corresponds to "forced division printing", and the lamp which corresponds to "stop printing" are turned on, respectively. Also, instead of displaying the operation selection dialog B, the lamp which corresponds to "resume printing" and the lamp which corresponds to "stop printing" are turned on, respectively (here, the lamp which corresponds to "forced division printing" is turned off).

Figure 7:
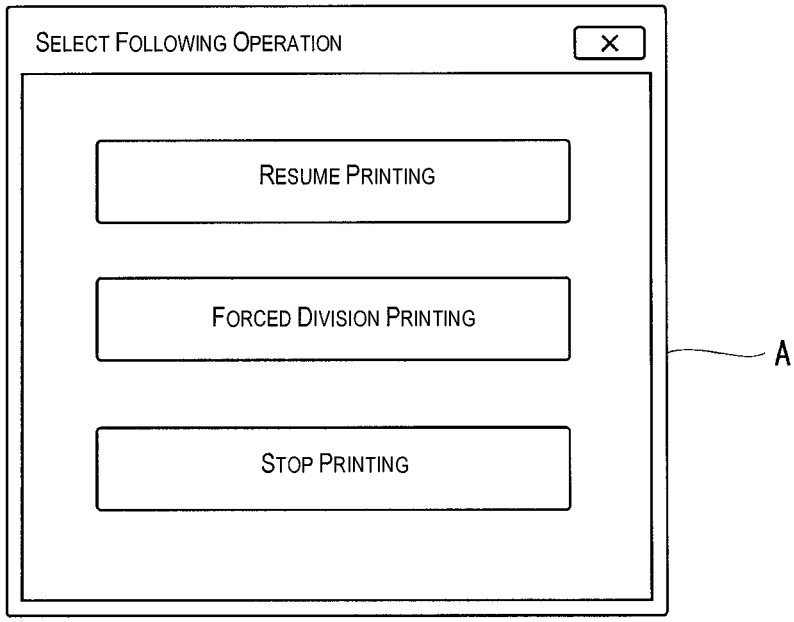
FIG. 7 is a diagram that shows other examples of the operation selection dialog A and the operation selection dialog B.
Figure 7:
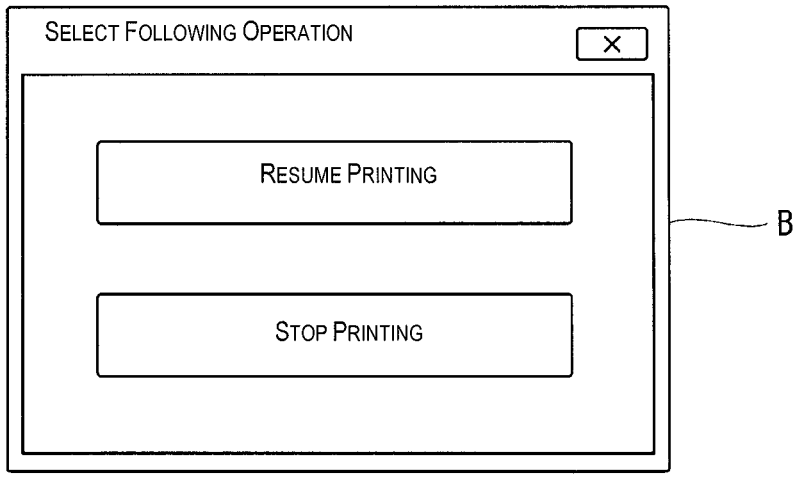

Also, in the present embodiment, the printing section 5 and the medium feed mechanism 12 are controlled by the control section 7 provided in the inkjet recording device 1. However, a control device constructed by a personal computer or the like can be provided separately from the inkjet recording device 1, and this control device can be provided with the control section 7. Further, in this case, the control device can be provided with the display section 8 and the operation section 9, and, for example, an operation selection dialog A and an operation selection dialog B shown in FIG. 7 are displayed on the display section 8.

Further, in the present embodiment, an interlaced method is used as the multipath method which is the printing method of the inkjet recording device 1. However, another multipath method such as an overlap method or a microwave method can be employed. Here, the overlap method refers to a printing method in which each raster line is formed by a plurality of nozzles 15*n*. For example, a raster line of the $m^{th}$ row is formed by the second nozzle 15*n* in the $n^{th}$ path (main scan) and is also formed by the first nozzle 15*n* in the $n+1^{th}$ path. Also, the microwave method refers to a printing method in which the interlaced method and the overlap method are combined.

What is claimed is:

1. An inkjet recording device comprising:

an image formation section which performs a printing operation by forming a plurality of raster lines arranged in a scanning direction and printing a printed image by a multipath method while relatively moving a recording medium with respect to an inkjet head in the scanning direction;

a control section which causes the image formation section to conduct a back end portion line formation process in response to inputting a stop command, the back end portion line formation process being a process for forming a raster line so as to prevent an unprinted portion due to the multipath method from being left in a back end portion of the printed image which has been printed halfway when the stop command is inputted, and causes the image formation section to stop the printing operation in response to ending of the back end portion line formation process.

2. The inkjet recording device according to claim 1, wherein the control section causes the image formation section to conduct a leading end portion line formation process for forming a raster line so as to prevent an unprinted portion due to the multipath method from being left in a leading end portion of a printed image which is printed after resuming when resuming a printing operation by the image formation section.

3. The inkjet recording device according to claim 1 further comprising an input section which allows a user to input the stop command to stop the printing operation.

4. The inkjet recording device according to claim 3 further comprising a display section which displays an operation selection screen including execution of the back end portion line formation process as a choice, wherein the control section tentatively stops the printing operation and causes the display section to display the operation selection screen in response to inputting the stop command before causing the image formation section to conduct the back end portion line formation process, and in a case where execution of the back end portion line formation process is selected on the operation selection screen, the control section causes the image formation section to conduct the back end portion line formation process and causes the image formation section to stop the printing operation in response to ending the back end portion line formation process.

5. An inkjet recording method comprising:

performing a printing operation by forming a plurality of raster lines arranged in a scanning direction and printing a printed image by a multipath method while relatively moving a recording medium with respect to an inkjet head in the scanning direction;

conducting a back end portion line formation process in response to inputting a stop command, the back end portion line formation process being a process for forming a raster line so as to prevent an unprinted portion due to the multipath method from being left in a back end portion of the printed image which has been printed halfway when the stop command is inputted; and stopping the printing operation in response to ending of the back end portion line formation process.

6. An inkjet recording system comprising:

an inkjet recording device; and a control device which controls the inkjet recording device, the inkjet recording device including an image formation section which performs a printing operation by forming a plurality of raster lines arranged in a scanning direction and printing a printed image by a multipath method while relatively moving a recording medium with respect to an inkjet head in the scanning direction, the control device including a control section which causes the inkjet recording device to conduct a back end portion line formation process in response to inputting a stop command, the back end portion line formation process being a process for forming a raster line so as to prevent an unprinted portion due to the multipath method from being left in a back end portion of the printed image which has been printed halfway when the stop command is inputted, and causes the image formation section to stop the printing operation in response to ending of the back end portion line formation process.

* * * * *